US009415973B2

(12) United States Patent
Rottlaender et al.

(10) Patent No.: US 9,415,973 B2
(45) Date of Patent: Aug. 16, 2016

(54) ENDLESS CABLE WINCH WITH SAFETY CABLE

(71) Applicant: Tractel Greifzug GmbH, Bergisch Gladbach (DE)

(72) Inventors: Thomas Rottlaender, Overath (DE); Klaus-Dieter Ott, Kuerten (DE); Juergen Gsell, Remscheid (DE)

(73) Assignee: TRACTEL GREIFZUG GMBH, Bergisch Gladbach (DE)

( * ) Notice: Subject to any disclaimer, the term of this patent is extended or adjusted under 35 U.S.C. 154(b) by 301 days.

(21) Appl. No.: 14/146,242

(22) Filed: Jan. 2, 2014

(65) Prior Publication Data

US 2014/0110649 A1 Apr. 24, 2014

Related U.S. Application Data

(63) Continuation of application No. PCT/EP2012/062573, filed on Jun. 28, 2012.

(30) Foreign Application Priority Data

Jul. 4, 2011 (DE) ..... 10 2011 106 636

(51) Int. Cl.
*B66D 5/32* (2006.01)
*B66B 5/04* (2006.01)
(Continued)

(52) U.S. Cl.
CPC ..... *B66B 5/04* (2013.01); *B66B 11/043* (2013.01); *B66D 1/20* (2013.01)

(58) Field of Classification Search
CPC ..... B66D 1/48; B66D 1/54; B66D 1/7415; B66D 3/10; B66D 3/20; B66D 5/04; B66D 5/06; B66D 5/34; B66B 5/04; B66B 5/046
See application file for complete search history.

(56) References Cited

U.S. PATENT DOCUMENTS 3,944,185 A 3/1976 Evans
3,946,989 A 3/1976 Tsuda
(Continued)

FOREIGN PATENT DOCUMENTS

CN 1502541 A 6/2004
CN 101088897 A 12/2007
(Continued)

OTHER PUBLICATIONS

International Search Report for PCT Application No. PCT/EP2012/062573, dated Oct. 22, 2012.
(Continued)

*Primary Examiner* — Emmanuel M Marcelo
(74) *Attorney, Agent, or Firm* — Ohlandt, Greeley, Ruggiero & Perle, LLP

(57) ABSTRACT

An endless cable winch or hoist which is particularly suited for a service lift comprises a working cable and a safety cable, further comprises a driving cable pulley around at least a part of which the working cable is wrapped, further comprises a drive for driving the driving cable pulley, further comprises a non-driven safety cable pulley, which is rotatably mounted in a housing and around at least a part of which the safety cable is wrapped, and further comprises an arresting device which is coupled via a brake to the cable pulley and which blocks and brakes the safety cable by means of the brake when the safety cable moves with a predetermined speed at least in one direction.

20 Claims, 5 Drawing Sheets

(51) Int. Cl.
*B66D 1/20* (2006.01)
*B66B 11/04* (2006.01)

(56) References Cited

U.S. PATENT DOCUMENTS 5,090,666 A * 2/1992 May ..... B66D 1/7415 254/329
5,188,341 A * 2/1993 Greaves ..... B62D 43/045 254/323
5,738,339 A * 4/1998 Kuryu ..... B66D 1/7415 182/234
5,927,438 A * 7/1999 Ostrobrod ..... A62B 1/08 182/192
5,975,498 A * 11/1999 Sauner ..... B62D 43/045 224/42.23
6,435,479 B1 * 8/2002 Raz ..... B66D 1/54 224/42.23
6,527,252 B2 * 3/2003 Dziedzic ..... B62D 43/045 224/42.12
7,527,243 B2 5/2009 Blasek
2010/0121493 A1 * 5/2010 Christensen ..... B63B 35/816 700/275

FOREIGN PATENT DOCUMENTS

DE 35 08 035 C2 3/1922
DE 26 33 124 C2 2/1978
DE 197 43 458 A1 6/1998
DE 202 17 287 U1 3/2003
DE 20 2005 019 439 U1 2/2006

OTHER PUBLICATIONS

Written Opinion for PCT Application No. PCT/EP2012/062573, dated Oct. 22, 2012.
International Preliminary Report on Patentability dated Jan. 7, 2014 for PCT Application No. PCT/EP2012/062573, 4 pages.
Chinese Office Action dated Apr. 3, 2015 for corresponding Chinese Patent Application No. 201280033303.2, with English translation, 16 pages.

* cited by examiner

ENDLESS CABLE WINCH WITH SAFETY CABLE

RELATED APPLICATIONS

This application is a continuation application of co-pending International Patent Application PCT/EP2012/062573 filed on Jun. 28, 2012 which claims priority of German patent application 10 2011 106 636.9 filed on Jul. 4, 2011 the contents of which is fully incorporated by reference herewith.

BACKGROUND OF THE INVENTION

The invention relates to an endless cable winch, in particular for a service lift, in particular for wind power plants, comprising a working cable and a safety cable, a driving cable pulley around at least a part of which the working cable is wrapped, a drive for driving the driving cable pulley, and further comprising a safety device for the safety cable.

Endless cable winches (also called "hoists") of this type are widely used for person transport applications. It is generally the case here that a lift cage, a platform or the like for receiving one or more persons is moved in an upward or downward direction by means of the endless cable winch along a cable depending from a building or the like. To provide a fall arrestor in the event of a cable breakage of the working cable or in the event of a gearbox failure of the endless cable winch, the safety cable is provided which runs jointly with and independently of the working cable and which, if the safety cable moves downward at too high a speed, generates a blocking action at the safety device, such that the safety cable is abruptly halted and the lift cage, the platform etc. is caught.

The abrupt braking in the event of failure of the working cable however results in a high load being exerted on the safety cable, and furthermore, the persons situated in the lifting device moved by the cable winch are subjected to intense physical and psychological stress.

SUMMARY OF THE INVENTION

It is one aspect of the present invention to disclose an endless cable winch which overcomes one of the disadvantages described above.

It is another aspect of the invention to disclose an endless cable winch which allows for a relatively smooth braking of the endless cable winch in the event of failure of the working cable.

It is still another aspect of the invention to disclose an endless cable winch which is of simple construction.

It is still another aspect of the invention to disclose an endless cable winch which is highly reliable.

It is still another aspect of the invention to disclose an endless cable winch which is of compact design.

These and other objects of the invention are achieved by an endless cable winch, comprising:

- a housing;
- a driving cable pulley received within said housing;
- a working cable extending through said cable winch, at least partially being wrapped around said driving cable pulley;
- a drive for driving said driving cable pulley;
- a non-driven safety cable pulley being mounted rotatably;
- a safety cable extending through said cable winch, at least partially being wrapped around said safety cable pulley;
- a friction brake being coupled to said cable pulley; and
- an arresting device coupled to said brake and configured for activating said brake for blocking and friction braking said safety cable when said safety cable reaches a predetermined threshold speed.

The object of the invention is hereby fully achieved.

Specifically, the fact that the arresting device blocks, and brakes the safety cable by means of the brake, when the predetermined speed is reached, has the result, during the catching of the safety cable by means of the safety device, of considerably slower braking of the safety cable as compared with the blocking arresting device used in the prior art, which acts directly on the safety cable.

Whereas it is the case in the prior art that braking accelerations of the order of magnitude of approximately 3 to 5 g arise during the direct catching of the safety cable by means of an arresting device, it is possible depending on the design of the brake device to realize a considerably lower braking acceleration, for example of the order of magnitude of approximately 2 g. This firstly has the result that the loading of the safety cable upon the response of the safety device is considerably reduced. Secondly, the physical and psychological stress on the personnel located in the person lifting device which is moved by means of the endless cable winch is reduced in this way.

In a preferred refinement of the invention, the arresting device comprises a ratchet wheel which interacts with a pawl mounted on the housing, in such a way that the pawl latches into the ratchet wheel at a predetermined speed of the safety cable.

In this way, an arresting device is provided which is highly robust and which is of simple and reliable design.

Here, in a preferred refinement of the invention, the pawl has a first pawl arm and a second pawl arm, between which the pawl is pivotably mounted on the housing, wherein the pawl is preloaded against the ratchet wheel in such a way that the first pawl arm can move along the ratchet wheel up to a predetermined speed, and latches with its second pawl arm into the ratchet wheel if the predetermined speed is exceeded in the downward direction of the safety cable.

In this way, it is possible to ensure reliable blocking of the ratchet wheel by means of the pawl. The predetermined speed at which the blocking takes place can be finely adjusted by means of the preload of the pawl.

In a further embodiment of the invention, a sensor is provided for detecting a blocking of the arresting device, which sensor outputs a signal which indicates a blocking of the arresting device.

In this way, the signal can be utilized, in the event of blocking of the arresting device, for example to shut off the drive and if appropriate implement further measures such as for example the transmission of a fault signal to a remote monitoring unit.

Furthermore, means for targetedly activating the arresting device may be provided, in particular a button for moving the pawl into a latching position for latching into the ratchet wheel.

In this way, the arresting device can be targetedly activated manually, mechanically, electrically or in some other way, for example in order, if a critical situation is detected, to activate the arresting device in order to generate a braking action.

Here, the arrangement may be such that the arresting device, after an activation, is automatically released again during a subsequent movement of the safety cable in the upward direction.

In a further embodiment of the invention, the ratchet wheel and the cable pulley are rotatable about a common axis of rotation, and the ratchet wheel forms a friction brake with the cable pulley.

A simple and reliable construction is ensured in this way.

In a further embodiment of the invention, the brake is in the form of a conical brake.

The design of the brake as a conical brake yields a particularly effective braking action with a relatively small installation size.

It is furthermore preferable for the friction brake to comprise a first friction partner composed of a bronze alloy and a second friction partner composed of a steel alloy.

It has been found that such a design of a friction brake for the application according to the invention yields particularly expedient configuration parameters which permit in particular a high braking force. It is alternatively possible for two friction partners to be used, at least one of which is provided with a friction lining.

Here, the brake preferably has a cone angle of approximately 4° to 10°.

A particularly expedient configuration of the brake can be attained in this way.

It is also alternatively possible for a friction lining to be provided on at least one of the friction partners. It is then generally the case here that a larger cone angle is also used, of the order of magnitude of approximately 10° to 40°.

This counteracts possible wear or seizing.

In a further preferred embodiment of the invention, the ratchet wheel has an external cone which is spring-loaded against an internal cone of the cable pulley.

Here, the ratchet wheel may be preloaded against the internal cone of the cable pulley for example by means of a plate spring, the preload of which is preferably adjustable.

These measures yield a simple and reliable construction.

The use of a plate spring makes it possible to impart a very high pressing force, such that high braking forces can be transmitted.

In a further embodiment of the invention, at least the working cable or the safety cable are wrapped around the driving cable pulley or the cable pulley with a wrap angle of less than 300°, preferably of approximately 260° to 280°, particularly preferably of approximately 270°.

Whereas it is the case in conventional endless cable winches that the wrap angle is normally 360°, it has been recognized according to the invention that a smaller wrap angle may also be adequate. With a smaller wrap angle of in particular approximately 270°, it is possible to dispense with a diverting roller if, in the case of the endless cable winch being used with a person lifting device, the cable should not be guided through the service lift itself but rather should be diverted laterally past the service lift and downwards by means of diverting rollers.

In a preferred refinement of the invention, the predetermined speed for the braking of the safety cable is 20 to 40 meters/minute, preferably 25 to 35 meters/minute, preferably approximately 30 meters/minute.

In this way, adherence to the triggering speed predefined by the European standard EN 1808 can be ensured.

In a further embodiment of the invention, the driving cable pulley and the cable pulley are mounted in a common housing.

In this way, it is possible for both the winch and also the safety device to be of compact construction in a common housing.

It would however basically also be conceivable for the safety device to be formed as a separate unit with the arresting device and the brake.

In a further embodiment of the invention, the cable pulley has a biasing device for biasing the safety cable against the cable pulley.

In a further embodiment of the invention, the driving cable pulley has a biasing device for biasing the working cable against the driving cable pulley.

Here, the biasing device may be for example a spring-loaded pressing roller.

These measures concern additional safety measures which are basically not necessary if both cables are preloaded or are loaded with a weight, but which lead to a further increase in safety.

Furthermore, the ratchet wheel may be mounted on a journal of the cable pulley.

Finally, a rotationally conjoint connection of the driving cable pulley and cable pulley to one another is also conceivable.

These measures yield a more simplified construction and a compact design of the safety device and of the endless cable winch as a whole.

The invention also provides a person lifting device, in particular a service lift, in particular for wind power plants, which has an endless cable winch of the type described above.

It is possible here for the working cable and the safety cable to be guided laterally out of the endless cable winch at an angle of approximately 90° relative to the upper strands, and diverted downward merely by means of in each case one diverting roller.

In this way, it is possible to attain simpler cable guidance while dispensing with further diverting rollers, and to attain a smaller structural height of the person lifting device, in particular of a hoisting cage.

It is self-evident that the features of the invention mentioned above and the features of the invention yet to be explained below can be used not only in the respectively specified combination but rather also in other combinations or individually, without departing from the scope of the present invention.

BRIEF DESCRIPTION OF THE DRAWINGS

Further features and advantages of the invention will be apparent from the following description of preferred exemplary embodiments with reference to the drawings, in which.

DETAILED DESCRIPTION OF PREFERRED EMBODIMENT

Figure 1:
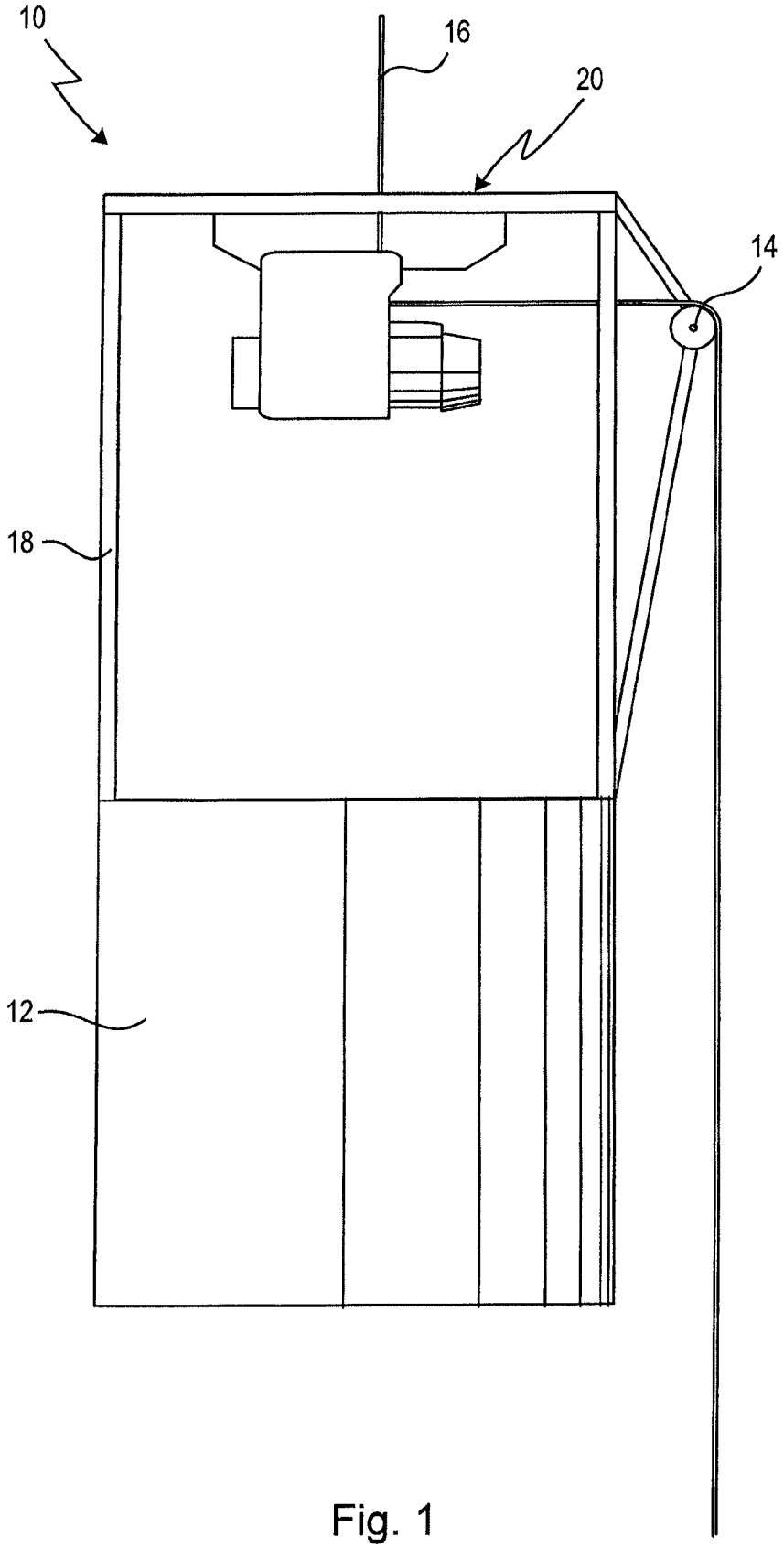
FIG. 1 shows, in a simplified side view, a person lifting device in the form of a service lift for a wind power plant.

FIG. 1 shows, in a side view and in a simplified illustration, a person lifting device in the form of a service lift for wind power plants.

The person lifting device denoted as a whole by 10 has a lift cage 12 with a frame 18, to the top end of which is fastened an endless cable winch 20.

The lift cage 12 hangs on a working cable which is guided through the endless cable winch 20 and which, laterally, is diverted downwards by means of a roller 14. Parallel to the working cable there runs a safety cable 16 which is likewise guided through the endless cable winch 20 and is guided laterally out of the endless cable winch 20 at an angle of 90° or 270° relative to the upper strand of the safety cable 16 and guided downwards by means of the diverting roller 14. In FIG. 1, it is possible to see only the course of the safety cable 16, because the working cable runs exactly parallel thereto and is thus hidden by the safety cable 16.

The construction and mode of operation of the endless cable winch 20 will now be explained in more detail below on the basis of FIGS. 2 to 6.

Figure 2:
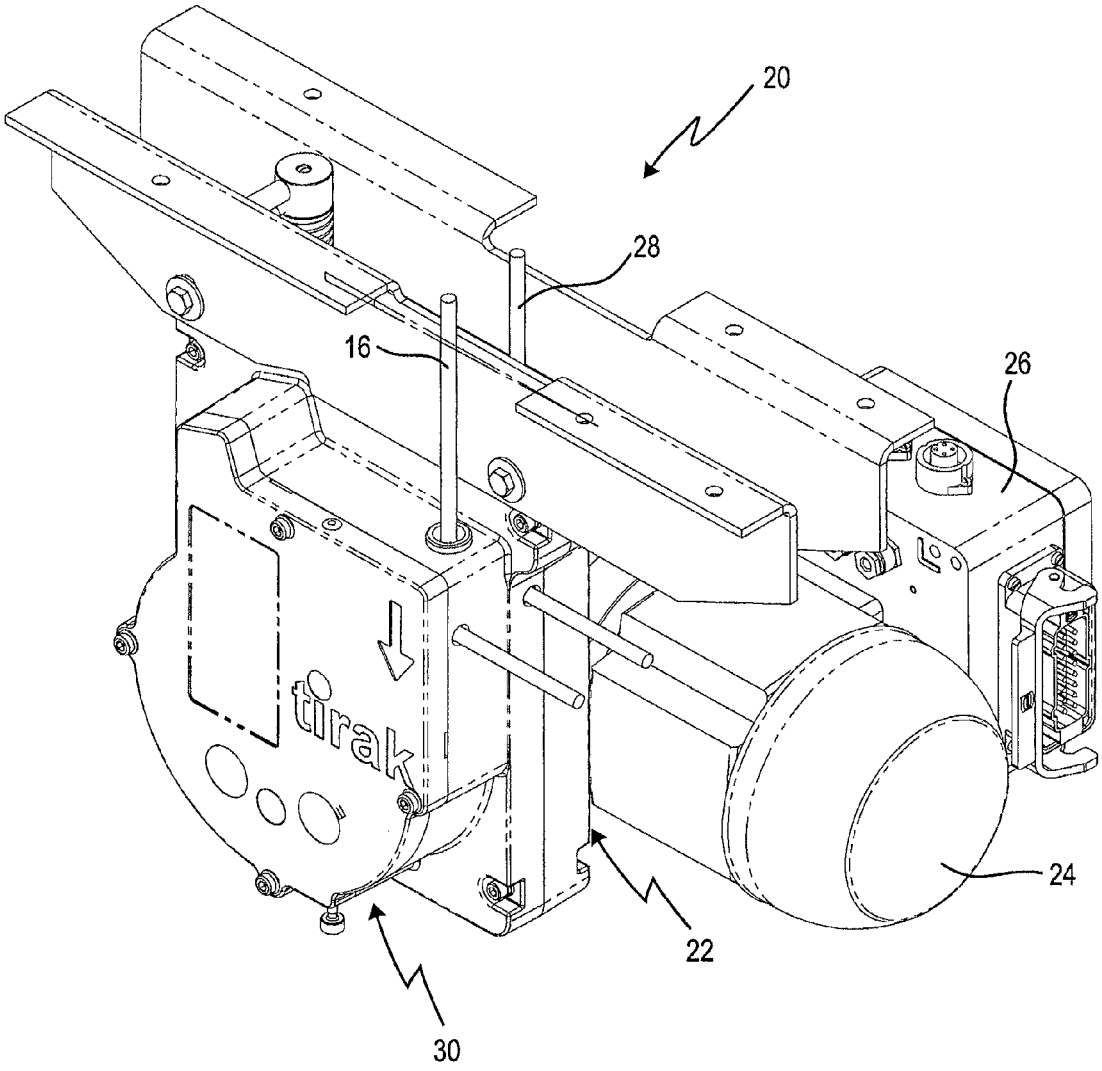
FIG. 2 shows a perspective illustration of an endless cable winch according to the invention which is used in the person lifting device as per FIG. 1.

FIG. 2 shows a perspective view of the endless cable winch 20. The endless cable winch 20 moves the working part 28 upwards or downwards such that the lift cage 12 moves upwards or downwards on the working cable 28. The winch 22 comprises a drive 24 with a motor and a gearbox, and also comprises a controller 26. The endless cable winch 20 comprises a winch 22 which moves the working part 28, and also a safety device 30 through which the safety cable 16 is guided.

Figure 3:
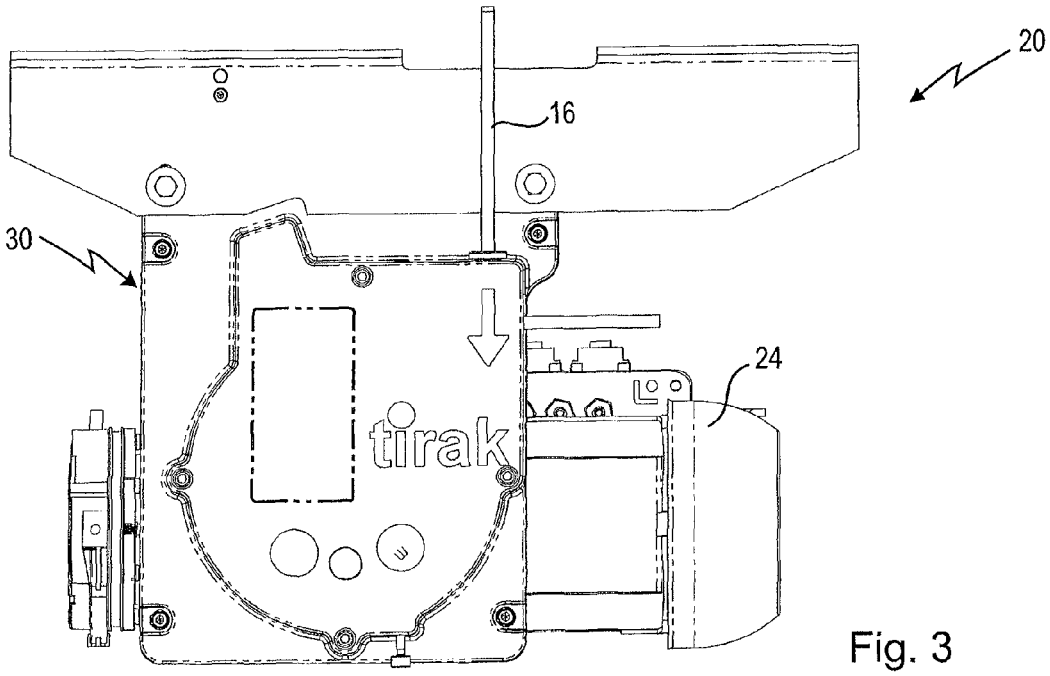
FIG. 3 shows a front view of the endless cable winch as per FIG. 2.
Figure 4:
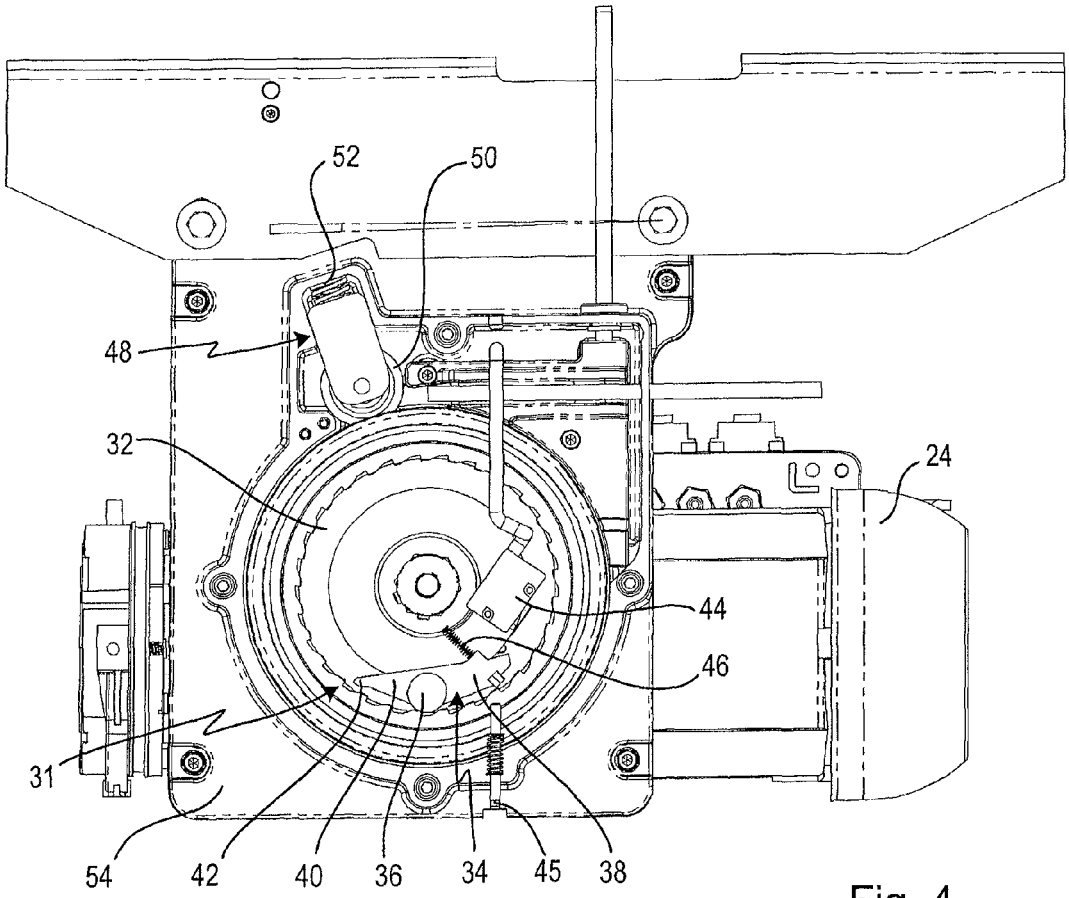
FIG. 4 shows a front view of the endless cable winch as per FIG. 3 in an enlarged illustration and after the housing cover has been removed.

FIG. 3 shows the endless cable winch 20 in a front view, whereas FIG. 4 shows the endless cable winch 20 in a slightly enlarged front view after the housing cover of the safety device 30 has been removed.

FIG. 4 shows the construction of an arresting device 31 which is part of the safety device 30. The arresting device 31 comprises a ratchet wheel 32 which interacts with a pawl 34 which is held so as to be pivotable about a pivot axis 36. The pawl 34 has a first pawl arm 38 and a second pawl arm 40 which protrude in opposite directions from the pivot axis 36. The pawl 34 is preloaded by a spring 46 in such a way that the first pawl arm 38 normally bears against the internal toothing of the ratchet wheel 32. In this position, the ratchet wheel can be moved both clockwise and also anticlockwise without the pawl leading to blocking against the ratchet wheel 32. If the ratchet wheel 32 moves anticlockwise as per the illustration in FIG. 4, the lift cage 12 moves downwards. Here, the pawl 34 runs with its first pawl arm 38 on the toothed inner surface of the ratchet wheel 32. The stress of the spring 46 is now set such that, when the downward speed of the safety cable 16 reaches approximately 30 meters per minute, the interaction of the first pawl arm 38 with the toothed inner surface of the ratchet wheel 32 causes the pawl 34 to lift from the inner surface of the ratchet wheel 32 and turn over, such that the pawl latches with a latching lug 42 at the end of the second pawl arm into the inner surface of the ratchet wheel 32, and the ratchet wheel 32 is thus blocked by means of the pawl 34 mounted in the housing 54. The arresting device 31 is thus arrested and causes the rotatably mounted ratchet wheel 32 to be fixed at the pawl 34.

In the arrested state, a switch 44 is actuated. The switch signals to the controller 26 that the drive 24 must be shut off. Furthermore, the switch 44 may also be utilized to output for example a fault signal, which is transmitted for example to a remote monitoring device, in the event of a response.

Figure 5:
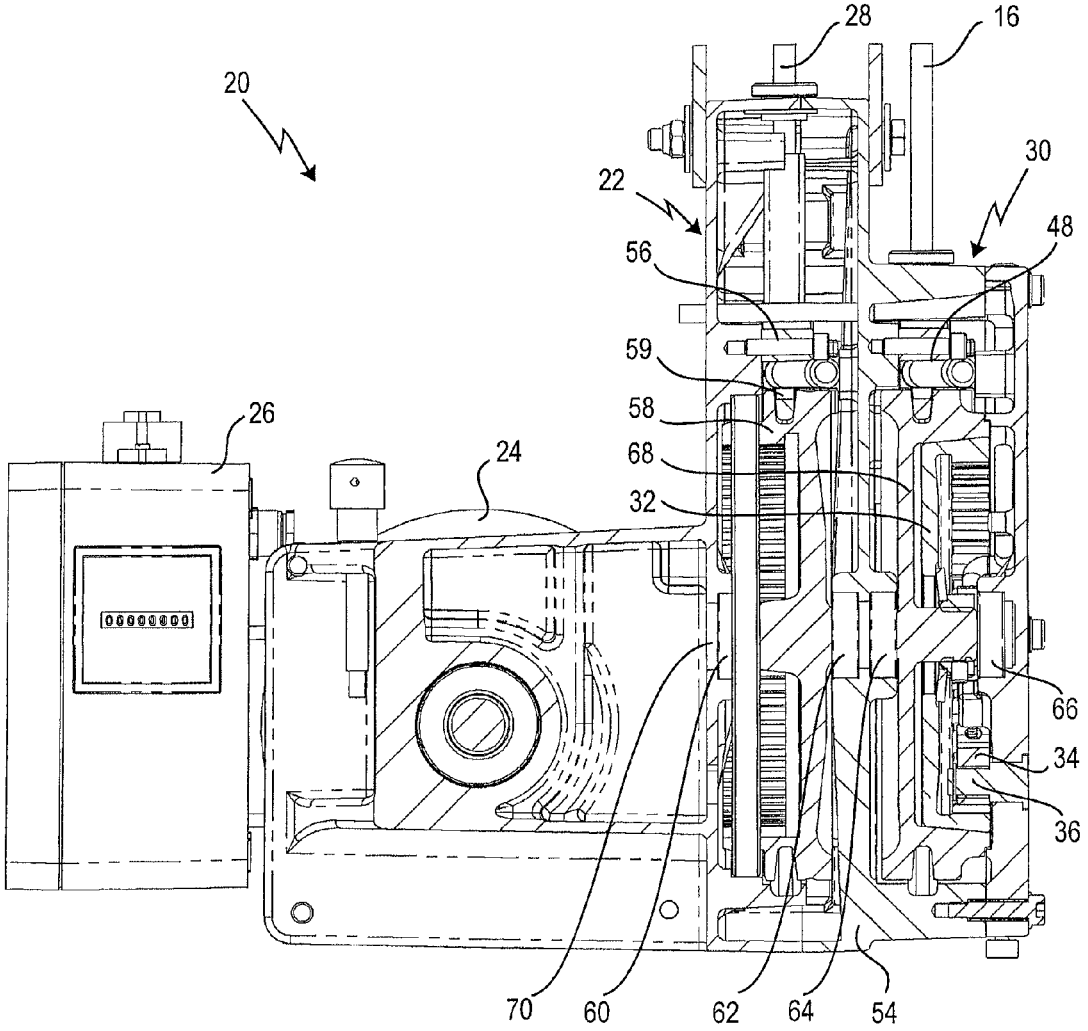
FIG. 5 shows a section through the endless cable winch as per FIG. 2.

FIG. 4 also shows a pressing device 48 for a cable pulley over which the safety cable 16 is guided (cf. FIG. 5). The pressing device 48 has a pressing roller 50 which is pressed by means of a spring 52 against the safety cable 16 in order to press the latter into an associated guide groove of the cable pulley 68 as per FIG. 5.

FIG. 5 furthermore shows the construction of the winch 22. The winch 22 has, in a way which is basically known, a driving cable pulley 58 over which the working cable 28 is guided with a wrap angle of approximately 270°. The driving cable pulley 58 has a guide groove 59 in which the working cable 28 runs. A pressing device 56 is also provided for pressing the working cable 28 into the guide groove 59. This pressing device involves a pressing roller combined with a spring. The working cable 28 emerges laterally out of the winch 22, as can be seen from FIG. 2, after a wrap angle of approximately 270°, and is then diverted downwards by means of the diverting roller 14.

FIG. 5 also shows the drive 24 which comprises an electric motor and a gearbox. The output shaft 70 of the gearbox drives the driving cable pulley 58 via a shaft-type pinion (not illustrated).

Figure 6:
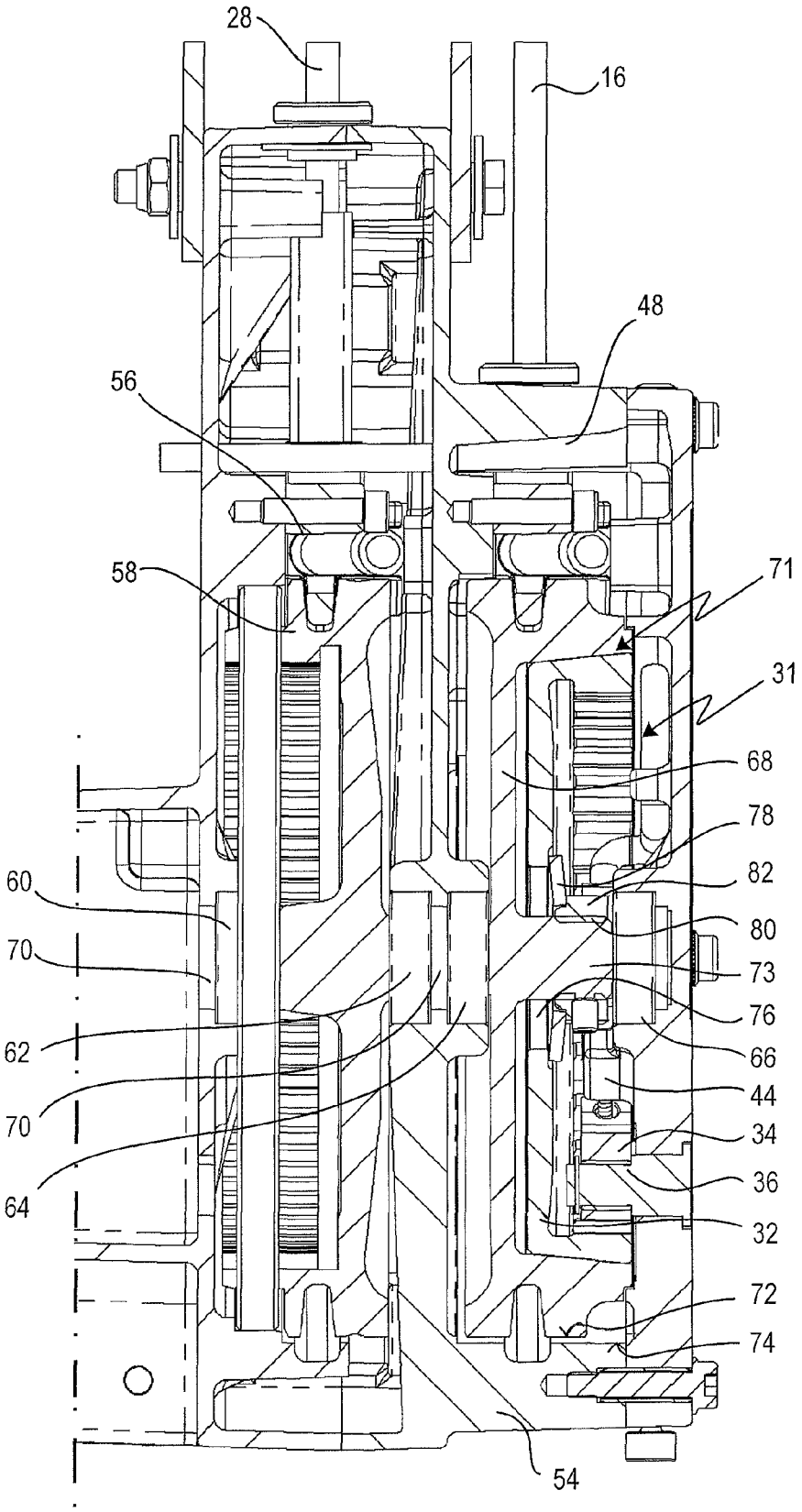
FIG. 6 shows, in an enlarged illustration, a partial section as per FIG. 5 in the region of the winch and safety device.

As can be seen from the enlarged illustration of FIG. 6, both the driving cable pulley and also the cable pulley are mounted in the common housing 54 of the winch 22 and of the safety device 30 by means of in each case two bearings 60, 62, 64, 66.

The safety device 30 comprises the arresting device 31 discussed above on the basis of FIG. 4, this safety device being coupled by means of a brake, denoted as a whole by numeral 71, to the cable pulley 68 over which the safety cable 16 is guided. The ratchet wheel 32 has an external cone 72 which bears against an internal cone 74 of the cable pulley 68. The ratchet wheel 32 is preloaded against the cable pulley 68 by means of a plate spring 78 which is supported against a bearing ring 76 on a journal 73 of the cable pulley, such that there is frictional engagement between the external cone 72 of the ratchet wheel 32 and the internal cone 74 of the cable pulley 68. The preload of the plate spring 78 can be adjusted by means of a nut 82 which is screwed onto a thread 80 on the journal 73.

The function of the safety device 30 is as follows:

In the normal situation, the non-driven cable pulley 68 runs synchronously with the driving cable pulley 58. The safety cable 16 thus moves at the same speed as the working cable 28 over the cable pulley 68.

If, for any reason, the winch 22 fails, either as a result of breakage of the working cable 28 or gearbox failure in the drive 24, which would cause the lift cage 12 to fall downwards, the lift cage 12 moves downwards initially at an increased speed until the triggering speed of the arresting device 31 is reached. At approximately 30 meters per minute, the pawl 34 blocks against the ratchet wheel 32, such that the previously rotating cable pulley 68 is now braked by means of the conical brake 71 until the lift cage 12 finally comes to a standstill.

The triggering speed for the arresting device 31 is approximately 30 meters per minute. The preload of the plate spring 78, the cone angle of the conical brake 71, which is approximately 5° to 8°, and the friction pairing of the materials of the internal cone 74 and external cone 72 (bronze alloy/steel alloy) are coordinated with one another such that, proceeding from the triggering speed of approximately 30 meters per minute, the lift cage 12 is braked with approximately 2 g. This constitutes considerably smoother braking than with conventional safety devices, by means of which the safety cable was immediately blocked, which led to catching of the lift cage 12 with approximately 5 g.

Instead of the direct material pairing of two metals (bronze alloy/steel alloy), it would also be possible for a friction lining to be provided on at least one friction partner in order to counteract possible wear as a result of corrosion or seizing. Here, it would then generally also be necessary to use a larger cone angle of the order of magnitude of approximately 10° to 40°, for example of approximately 30°.

By means of a button 45, the pawl 34 can also be moved into its arresting position manually, mechanically, electrically or in some other way (cf. FIG. 5). For this purpose, the button 45 is actuated once in order to pivot the pawl 34. The arresting position is automatically eliminated again if the safety cable 16 is moved in the upward direction again.

What is claimed is:

1. An endless cable winch, comprising:

a housing;

a driving cable pulley received within said housing;

a working cable extending through the endless cable winch, at least partially being wrapped around said driving cable pulley;

a drive for driving said driving cable pulley for moving the endless cable winch along said working cable;

a non-driven safety cable pulley being mounted rotatably about an axis of rotation;

a safety cable extending through the endless cable winch, at least partially being wrapped around said safety cable pulley;

a friction brake being coupled to said safety cable pulley; and an arresting device comprising a ratchet wheel mounted rotatably within said housing on an axis common with said axis of rotation, and a pawl mounted on said housing engaging said ratchet wheel being coupled to said brake and being configured for activating said brake for blocking and braking said safety cable when said safety cable reaches a threshold speed at least in one direction;

said pawl further comprising a first pawl arm and a second pawl arm, between which said pawl is pivotably mounted on said housing, said pawl being preloaded against said ratchet wheel so as to allow moving said first pawl arm along said ratchet wheel up to said threshold speed, and to effect latching with said second pawl arm into said ratchet wheel upon reaching said threshold speed of said safety cable, thereby activating said friction brake.

2. The endless cable winch of claim 1, further comprising a sensor for detecting a blocking of said arresting device, said sensor being configured for outputting a signal indicating said blocking.

3. The endless cable winch of claim 1, wherein said friction brake is configured as conical brake.

4. The endless cable winch of claim 3, wherein said friction brake comprises a cone angle of approximately 4° to 10°.

5. The endless cable winch of claim 3, wherein said ratchet wheel comprises an external cone which is spring-loaded against an internal cone arranged on said safety cable pulley.

6. The endless cable winch of claim 5, wherein said ratchet wheel is preloaded against said internal cone of said safety cable pulley by a plate spring.

7. The endless cable winch of claim 3, wherein said ratchet wheel is mounted on a journal of said safety cable pulley.

8. The endless cable winch of claim 1, wherein said friction brake comprises a first friction partner composed of a bronze alloy and a second friction partner composed of a steel alloy.

9. The endless cable winch of claim 1, wherein said threshold speed for braking said safety cable is 20 to 40 meters/minute.

10. The endless cable winch of claim 1, wherein said driving cable pulley and said safety cable pulley are mounted in said common said housing.

11. An endless cable winch, comprising:

a housing;

a driving cable pulley received within said housing;

a working cable extending through the endless cable winch, at least partially being wrapped around said driving cable pulley;

a drive for driving said driving cable pulley;

a non-driven safety cable pulley being mounted rotatably;

a safety cable extending through the endless cable winch, at least partially being wrapped around said safety cable pulley;

a friction brake being coupled to said safety cable pulley;

an arresting device being coupled to said brake and being configured for activating said brake for blocking and friction braking said safety cable when said safety cable reaches a threshold speed at least in one direction.

12. The endless cable winch of claim 11, further comprising a sensor for detecting a blocking of said arresting device, said sensor being configured for outputting a signal indicating said blocking.

13. The endless cable winch of claim 11, wherein said friction brake is configured as a conical brake.

14. The endless cable winch of claim 13, wherein said friction brake comprises a cone angle of approximately 4° to 10°.

15. The endless cable winch of claim 11, wherein said arresting device comprises a ratchet wheel mounted rotatably within said housing, and a pawl mounted on said housing cooperating with said ratchet wheel, for latching into said ratchet wheel when said safety cable reaches said threshold speed.

16. The endless cable winch of claim 15, wherein said ratchet wheel comprises an external cone which is spring-loaded against an internal cone arranged on said safety cable pulley.

17. The endless cable winch of claim 16, wherein said ratchet wheel and said cable pulley are rotatable about a common axis of rotation, and wherein said ratchet wheel forms said friction brake with said safety cable pulley.

18. The endless cable winch of claim 15, wherein said pawl comprises a first pawl arm and a second pawl arm, between which said pawl is pivotably mounted on said housing, wherein said pawl is preloaded against said ratchet wheel so that said first pawl arm can move along said ratchet wheel up to said threshold speed, and latches with its second pawl arm into said ratchet wheel if said predetermined speed is exceeded in a downward direction of said safety cable.

19. An endless cable winch, comprising:

a housing;

a driving cable pulley received within said housing;

a working cable extending through the endless cable winch, at least partially being wrapped around said driving cable pulley;

a drive for driving said driving cable pulley;

a non-driven safety cable pulley being mounted rotatably;

a safety cable extending through the endless cable winch, at least partially being wrapped around said safety cable pulley;

a friction brake being coupled to said safety cable pulley; and an arresting device comprising a ratchet wheel mounted rotatably within said housing on a common axis with said safety cable pulley, and a pawl mounted on said housing cooperating with said ratchet wheel, for latching into said ratchet wheel when said safety cable reaches said threshold speed of said safety cable;

said ratchet wheel together with said safety cable pulley forming said friction brake being activated upon latching of said pawl for blocking and friction braking said safety cable when said safety cable reaches said threshold speed.

20. The endless cable winch of claim 19, wherein the endless cable winch is attached to a service lift supported on said working cable.

* * * * *